US005813327A

United States Patent [19]

Freeman et al.

[11] Patent Number: 5,813,327

[45] Date of Patent: Sep. 29, 1998

[54] ARTICLE TRANSPORT APPARATUS

[75] Inventors: Gerald C. Freeman, Norwalk, Conn.; Douglas M. Mattingly, Cary, N.C.; Edilberto I. Salazar, Brookfield, Conn.

[73] Assignee: Pitney Bowes Inc., Stamford, Conn.

[21] Appl. No.: 773,149

[22] Filed: Dec. 26, 1996

[51] Int. Cl.[6] ..... B41J 13/26

[52] U.S. Cl. ..... 101/93; 101/232; 101/91; 400/582; 271/10.01

[58] Field of Search ..... 101/91, 92, 93, 101/232, 233, 234; 271/10.01, 11, 12, 13, 111; 400/582; 364/464.02; 347/2, 104, 105

[56] References Cited

U.S. PATENT DOCUMENTS

| | | | |
|---|---|---|---|
| 4,235,431 | 11/1980 | Abrams et al. | 271/10 |
| 4,451,027 | 5/1984 | Alper | 271/10 |
| 4,541,624 | 9/1985 | Sasage et al. | 271/12 |
| 4,573,673 | 3/1986 | Haug | 271/111 |
| 4,691,912 | 9/1987 | Gillmann | 271/10 |
| 4,787,311 | 11/1988 | Mol | 101/232 |
| 4,931,712 | 6/1990 | DiGiulio et al. | 318/625 |
| 4,933,616 | 6/1990 | Chang et al. | 318/561 |
| 4,935,078 | 6/1990 | Bergman et al. | 156/64 |
| 4,959,600 | 9/1990 | DiGiulio et al. | 318/625 |
| 4,978,114 | 12/1990 | Holbrook | 271/35 |
| 5,211,387 | 5/1993 | Lloyd et al. | 271/111 |

*Primary Examiner*—Christopher A. Bennett
*Attorney, Agent, or Firm*—Angelo N. Chaclas; Melvin J. Scolnick

[57] ABSTRACT

An apparatus and method for transporting a mailpiece. The apparatus comprises an assembly for feeding the mailpieces in a path of travel; a sensor assembly for determining the length of the mailpieces; and a controller in operative communication with the sensor assembly and the feeding assembly, the controller for adjusting the gap between a first mailpiece having a measured length and a second mailpiece to: (i) establish a fixed pitch between the first mailpiece and the second mailpiece if the measure length is equal to or less than a predetermined value, or (ii) establish a fixed gap between the first mailpiece and the second mailpiece if the measure length is greater than the predetermined value. The method comprises the steps of feeding the mailpieces in a path of travel; determining the length of the mailpieces; and adjusting the gap between a first mailpiece having a determined length and a second mailpiece to establish a fixed pitch between the first mailpiece and the second mailpiece if the determined length is equal to or less than a predetermined value.

8 Claims, 3 Drawing Sheets

ARTICLE TRANSPORT APPARATUS

CROSS REFERENCE TO RELATED APPLICATIONS

This application is related to copending U.S. patent application Ser. Co./No. 08/717,788; filed on Sep. 23, 1996, and entitled MAILING MACHINE (Attorney Docket E-516).

FIELD OF THE INVENTION

This invention relates to an article transport apparatus. More particularly, this invention is directed to a mailing machine transport apparatus which maintains a predetermined spacing between successive mailpieces.

BACKGROUND OF THE INVENTION

Mailing machines are well known in the art. Generally, mailing machines are readily available from manufacturers such as Pitney Bowes Inc. of Stamford, Conn. Mailing machines often include a variety of different modules which automate the processes of producing mailpieces. The typical mailing machine includes a variety of different modules or sub-systems where each module performs a different task on the mailpiece, such as: singulating (separating the mailpieces one at a time from a stack of mailpieces), weighing, moistening/sealing (wetting and closing the glued flap of an envelope), applying evidence of postage, accounting for postage used and stacking finished mailpieces. However, the exact configuration of each mailing machine is particular to the needs of the user. Customarily, the mailing machine also includes a transport apparatus which feeds the mailpieces in a path of travel through the successive modules of the mailing machine.

One indicator customers use to evaluate and measure the performance of mailing machines is overall mailing machine throughput. Conventionally, throughput is defined as the number of mailpieces processed per minute. Typically, customers desire to process as many mailpieces per minute as possible. Thus, it is desirable to have the smallest gap possible between successive mailpieces. In this way, operating costs are reduced and customers may recoup their investment in the mailing machine as quickly as possible.

Another indicator customers use to evaluate and measure the performance of mailing machines is reliability. Conventionally, several measures of reliability may be used, such as: mean time between failures, or number of failures per 10,000 mailpieces. Typically, customers desire that the mailing machine operate for long periods of time with minimal operator intervention. This also reduces operating costs for the customers. However, increasing the rate of throughput may work against improved reliability by increasing the risk of jams. A jam is a common type of failure which occurs when two successive mailpieces collide together. Jams create downtime for the mailing machine which impacts throughput and also requires operator intervention to correct. Therefore, the gap between successive mailpieces must not be so small so as to increase the likelihood of jams.

Thus, the competing interests of high throughput and high reliability must be balanced. To process mailpieces at a high rate, it is desirable to have the gap or spacing between successive mailpieces be as small as possible. On the other hand, if the spacing is too small, then the risk of jams due to overlapping of mailpieces is greatly increased.

Still another indicator customers use to evaluate and measure the performance of mailing machines is the ability to handle mailpieces of mixed sizes. This capability eliminates the need to presort the mailpieces into similar sized batches for processing. Since this presorting is often a manual task, a great deal of labor, time and expense is saved through mixed mailpiece feeding.

Some prior art systems, such as those described in U.S. Pat. No. 4,541,624, seek to address these issues by feeding articles at a fixed pitch in either lead edge or trail edge alignment. That is, the length of the article plus its associated gap is always equal to a constant regardless of the size of the article. Thus, in fixed pitch systems, the gap will vary depending upon the size of the article.

Although these fixed pitch systems generally work well, they suffer from disadvantages and drawbacks. For example, the pitch must be set sufficiently large so as to accommodate the size of the largest article so that jams do not occur when feeding large articles. However, as a result, when smaller articles are being fed, the gap necessarily must increase and efficiency is reduced.

Other prior art systems, such as those described in U.S. Pat. No. 4,451,027, seek to address these issues by feeding articles with a fixed gap regardless of the size of the article. That is, the gap between articles is constant regardless of the size of the article. Thus, in fixed gap systems, the pitch will vary depending upon the size of the article.

Although these fixed gap systems generally work well, they suffer from disadvantages and drawbacks. For example, the gap must be set sufficiently large so as to accommodate the size of the smallest article so that each module of the article handling apparatus has a sufficient amount of time to perform its tasks. Thus, the size of the smallest article taken along with the size of the gap cannot be so small so as to exceed the capabilities of the remainder of the article handling apparatus. However, as a result, when larger articles are being fed, the constant gap is unnecessarily large and throughput is reduced because the modules can easily perform their tasks since it takes a longer amount of time to feed the larger articles.

Therefore, there is a need for a transport apparatus which operates to feed articles or mailpieces in singular fashion where the spacing between envelopes is controlled so as to achieve a predetermined or desired gap distance which is selected to optimize overall system performance for both small and large mailpieces.

SUMMARY OF THE INVENTION

The present invention provides an apparatus for transporting mailpieces, envelopes or the like. Conventionally, this invention may be incorporated into a mailing machine or other article handling apparatuses.

In accordance with the present invention, the apparatus comprises a means for feeding the mailpieces in a path of travel; means for determining the length of the mailpieces; and control means in operative communication with the determining means and the feeding means, the control means for adjusting the gap between a first mailpiece having a measured length and a second mailpiece to: (i) establish a fixed pitch between the first mailpiece and the second mailpiece if the measure length is equal to or less than a predetermined value, or (ii) establish a fixed gap between the first mailpiece and the second mailpiece if the measure length is greater than the predetermined value.

In accordance with the present invention, the method comprises the step(s) of feeding the mailpieces in a path of travel; determining the length of the mailpieces; and adjusting the gap between a first mailpiece having a determined length and a second mailpiece to establish a fixed pitch between the first mailpiece and the second mailpiece if the determined length is equal to or less than a predetermined value.

Therefore, it is now apparent that the invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
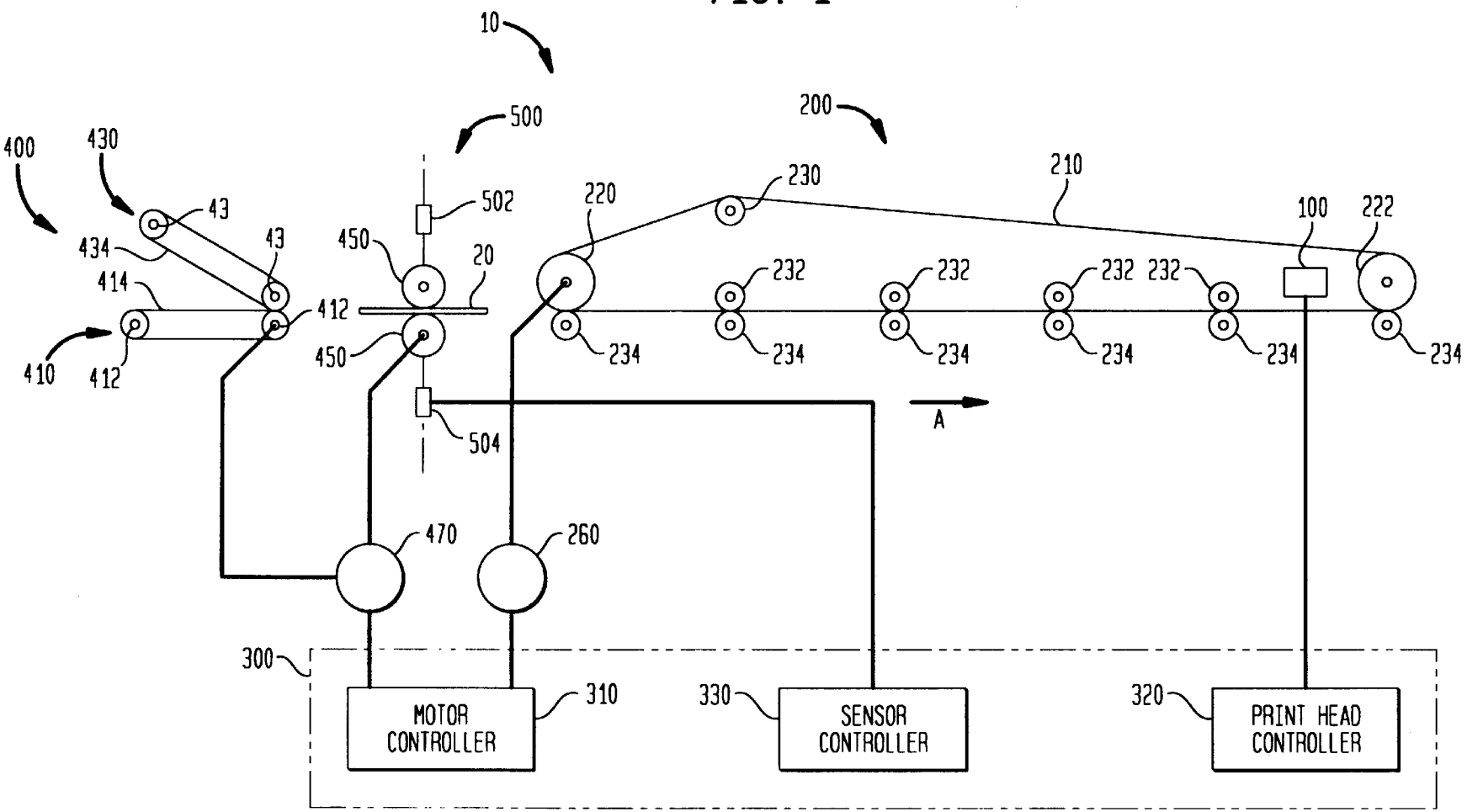
FIG. 1 is a simplified schematic of a front elevational view of a mailing machine which incorporates the present invention.

Referring to FIG. 1, a mailing machine 10 including a print head module 100, a conveyor apparatus 200, a micro control system 300 and a singulator module 400 is shown. Other modules of the mailing machine 10, such as those described above, have not been shown for the sake of clarity. The singulator module 400 receives a stack of envelopes (not shown), or other mailpieces such as postcards, folders and the like, and separates and feeds them at variable speed in a seriatim fashion (one at a time) in a path of travel as indicated by arrow A. Downstream from the path of travel, the conveyor apparatus 200 feeds envelopes at constant speed in the path of travel along a deck (not shown) past the print head module 100 so that an indicia of postage can be printed on each envelope 20. Together, the singulator module 400 and the conveyor module 200 make up a transport apparatus for feeding the envelopes 20 through the various modules of the mailing machine 10.

The print head module 100 is of an ink jet print head type having a plurality of ink jet nozzles (not shown) for ejecting droplets of ink in response to appropriate signals. The print head module 100 may be of any conventional type such as those commonly available from The Hewlett-Packard Company and Canon Inc. Since the print head module 100 does not constitute a part of the present invention, further description is unnecessary.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor as the feeder assembly 410.

Since the details of the singulator module 400 are not necessary for ar understanding of the present invention, no further description will be provided. However, an example of a singulator module suitable for use in conjunction with the present invention is described in U.S. Pat. No. 4,7978, 114, entitled REVERSE BELT SINGULATING APPARATUS, the disclosure of which is specifically incorporated herein by reference.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the take-away roller drive train so that the take-away rollers 450 operate at a higher speed than the feeder assembly 410. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The mailing machine 10 further includes a sensor module 500 which is substantially in alignment with the nip of take-away rollers 450 for detecting the presence of the envelope 20. Preferably, the sensor module 500 is of any conventional optical type which includes a light emitter 502 and a light detector 504. Generally, the light emitter 502 and the light detector are located in opposed relationship on opposite sides of the path of travel so that the envelope 20 passes therebetween. By measuring the amount of light that the light detector 504 receives, the presence or absence of the envelope 20 can be determined.

Generally, by detecting the lead and trail edges of the envelope 20, the sensor module 500 provides signals to the micro control system 300 which are used to determine the length of the envelope 20. The amount of time that passes between the lead edge detection and the trail edge detection, along with the speed at which the envelope 20 is being fed, can be used to determine the length of the envelope 20. Additionally, using similar techniques, the sensor module 500 measures the length of the gaps between envelopes 20 by detecting the trail edge of a first envelope and the lead edge of a subsequent envelope. Alternatively, an encoder system (not shown) can be used to measure the envelope 20 and gap lengths by counting the number of encoder pulses which are directly related to a known amount of rotation of the take-away rollers 450. Thus, the lengths can be determined in this fashion. Such techniques are well known in the art.

The conveyor apparatus 200 includes an endless belt 210 looped around a drive pulley 220 and an encoder pulley 222 which is located downstream in the path of travel from the drive pulley 220 and proximate to the print head module 100. The drive pulley 220 and the encoder pulley 222 are substantially identical and are fixably mounted to respective shafts (not shown) which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively.

As described above, the normal force rollers 234 work to bias the envelope 20 up against the deck (not shown). This is commonly referred to as top surface registration which is beneficial for ink jet printing. Any variation in thickness of the envelope 20 is taken up by the deflection of the normal force rollers 234. Thus, a constant space (the distance between the print head module 100 and the deck 240) is set between the envelope 20 and the print head module 100 no matter what the thickness of the envelope 20. The constant space is optimally set to a desired value to achieve quality printing. It is important to note that the deck (not shown) contains suitable openings for the endless belt 210 and normal force rollers 234.

A more detailed description of the conveyor apparatus 200 is found in copending U.S. patent application Ser. Co./No. 08/717,788; filed on Sep. 23, 1996, and entitled MAILING MACHINE (Attorney Docket E-516), the disclosure of which is specifically incorporated herein by reference.

The singulator module 400, conveyor apparatus 200 and the print head module 100, as described above, are under the control of the micro control system 300 which may be of any suitable combination of microprocessors, firmware and software. The micro control system 300 includes a motor controller 310 which is in operative communication with the motors 260 and 470 and a print head controller 320 which is in operative communication with the print head module 100. Additionally, the micro control system 300 is in operative communication with the sensor module 500 for receiving input signals from the light detector 504 which are indicative of the presence or absence of the envelope 20.

It is important to note that the singulator module 400 and the conveyor apparatus 200 have respective encoder systems which are in communication with the micro control system 300. In this manner, the micro control system 300 can monitor the performance of the singulator module 400 and the conveyor apparatus 200 and issue appropriate drive signals to motors 470 and 260, respectively.

With the structure of the mailing machine 10 described as above, the operational characteristics will now be described with respect to FIGS. 1 and 3. Generally, the singulator module 400 and the conveyor apparatus 200 work cooperatively to feed envelopes in one of three modes: fixed pitch, fixed gap or straight through, depending upon the length of the envelope 20 and the length of the gap between successive envelopes. The conveyor apparatus 200 operates to feed the envelope at a constant speed of 40 inches per second (ips). On the other hand, the singulator module 400 operates at variable speeds. However, the feeder assembly 410 operates at substantial periods of time at 36 ips while during those same periods the take-away rollers 450 operate at 40 ips. This creates a gab between successive envelopes due to the speed differential. It is important to note that the speed of the take-away rollers 450 is matched to the speed of the conveyor apparatus 200 as the envelope 20 passes from one nip to the other nip. In this manner, tugging or buckling of the envelope 20 is avoided.

Generally, the mailing machine 10 operates in fixed pitch mode when feeding #10 envelopes (9.5 inches in length) and smaller envelopes. In fixed pitch mode, the length of the envelope 20 plus its associated gap is always equal to a constant fixed pitch P regardless of the size of the envelope 20. Thus, the desired gap will vary depending upon the size of the envelope 20.

In the preferred embodiment, the operation of the mailing machine 10 is optimized for handling #10 envelopes which are most prevalent for use in outgoing business mailings. That is, the feeding of #10 envelopes is coordinated with the other modules of the mailing machine 10 so that a high rate of throughput and reliability is achieved. Additionally, all of the other modules of the mailing machine 10 must perform their associated tasks in the amount of time necessary to feed a #10 envelope at 40 ips at the constant fixed pitch P through the module. For example, the print head module 100 must apply a postal indicia to the envelope 20 and an accounting module (not shown) must account for the value of the postage dispensed within this time period. Generally, the limiting factors for overall throughput is not the feed speed of the envelope 20, but instead is the time necessary to perform these other tasks.

Preferably, the constant fixed pitch P is set equal to 11.5 inches which creates a 2.0 inch gap in between #10 envelopes. Any envelope 20 smaller than a #10 envelope would have a gap larger than 2.0 inches so as to achieve the constant fixed pitch P of 11.5 inches. Although any envelope 20 smaller than a #10 envelope would have a gap larger than 2.0 inches, the overall throughput of the mailing machine 10 remains the same because of the constant fixed pitch P. Also, it is not practical to reduce the gap between envelopes 20 smaller than a #10 envelope because that may not provide enough time for the various modules of the mailing machine 10 to perform their tasks. For example, the bandwidth of the overall mailing machine 10 is 210 cycles per minute.

Generally, the mailing machine 10 operates in fixed gap mode when feeding envelopes 20 larger than #10 envelopes (greater than 9.5 inches in length). In fixed gap mode, a constant gap G is set between envelopes 20 regardless of the size of the envelope 20. Thus, the pitch between envelopes 20 will vary depending upon the size of the envelope 20.

Preferably, the constant gap G is set equal to 2.0 inches which ensures that sufficient spacing exists between envelopes 20 so that jams do not occur. Since the fixed gap mode always results in a pitch between envelopes 20 which is greater than the constant fixed pitch P of 11.5 inches, more time is available per envelope 20. Thus, overall throughput necessarily goes down. However, the various modules of the mailing machine 10 have enough time to perform their tasks.

It should now be apparent that for every size of envelope 20, there exists a respective desired gap. For example, the desired gap for any envelope 20 with a length equal to or greater than 9.5 inches is 2.0 inches. On the other hand, the desired gap for envelopes 20 with a length less than 9.5 inches is variable. As other examples, the desired gap for an envelope 20 with a length of 7.0 inches is 4.5 inches while the desired gap for an envelope 20 with a length of 6.0 inches is 5.5 inches.

The mailing machine 10 operates in straight through mode when the measured gap is greater than the desired gap for a given envelope length. That is, the feeder assembly 410 and the take-away rollers 450 operate at constant speed without any compensation or adjustment of the measured gap. Therefore, the feeder assembly 410 and the take-away rollers 450 do not operate to reduce the measured gap to the desired gap. Instead, they only operate to increase the measured gap to the desired gap by initially slowing down the envelope 20 and then speeding up the envelope 20 so that the envelope 20 is back up to 40 ips by the time the envelope 20 reaches the nip of the conveyor apparatus 200. Any conventional servo control system with suitable velocity profiles can be used to implement this step. It should now be apparent that the straight through mode can override both the fixed pitch mode and the fixed gap mode if the measured gap is greater than the desired gap for a given envelope length.

The velocity profiles may be developed to reduce motor 470 performance requirements and reduce skew of the envelope 20 by minimizing deceleration and acceleration rates. Preferably, deceleration rates should not exceed 2 g-force (64 feet per second squared) so as not to skew large envelopes 20 which contact the take-away rollers 450 offset from their center of gravity. Also, acceleration rates should not exceed 1 g-force (32 feet per second squared) so that smaller and less costly motors can be used.

Figure 2:
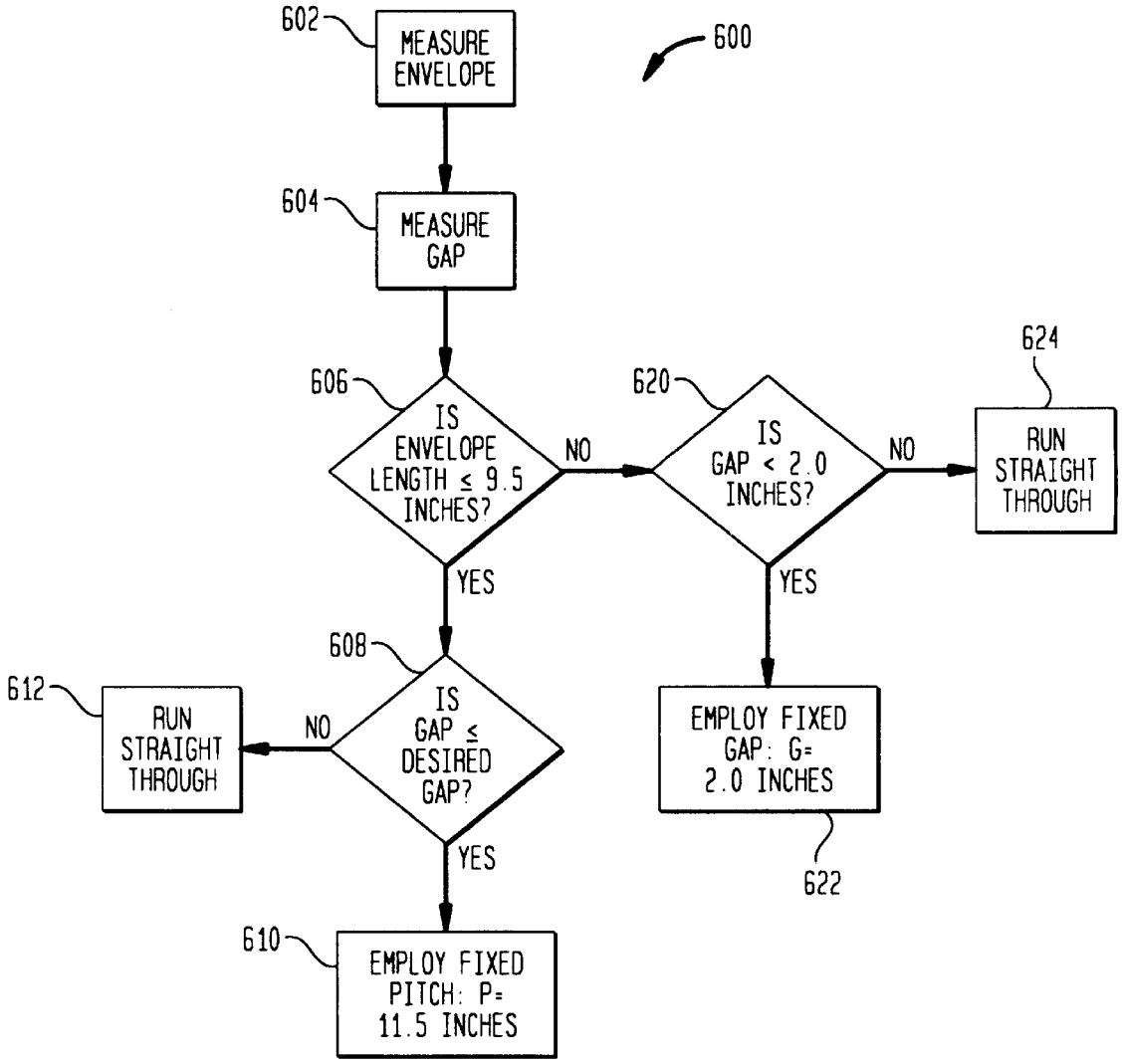
FIG. 2 is a flow chart showing the operation of the mailing machine in accordance with the present invention.

Referring primarily to FIG. 2 while referencing the structure of FIG. 1, a s flow chart 600 of the operation of the mailing machine 10 in accordance with the present invention is shown. At 602, the micro control system 300 determines the length of the envelope 20 from the inputs received from the sensor module 500. Next, at 604, the micro control system 300 determines the length of the gap immediately following the envelope 20 also from the inputs received from the sensor module 500. At 606, a determination is made whether the length of the envelope 20 is less than or equal to 9.5 inches. If so, then at 608, a determination is made whether the length of the gap is less than or equal to the desired gap for given length of the envelope 20. If so, then at 610, the micro control system 300 instructs the mailing machine 10 to enter fixed pitch mode. Thus, micro control system 300 provides suitable signals to the motor 470 via the motor controller 310 so as to initially slow down the envelope 20 and then return the envelope 20 to 40 ips before feeding the envelope 20 to the conveyor apparatus 200 while establishing the desired gap. If at 608 the answer is no, then at 612 the mailing machine operates in straight through mode where no gap correction takes place.

If at 606 the answer is no, then at 620 a determination is made whether the length of the gap is less than or equal to 2.0 inches. If so, then at 622, the micro control system 300 instructs the mailing machine 10 to enter fixed gap mode. Thus, micro control system 300 provides suitable signals to the motor 470 via the motor controller 310 so as to initially slow down the envelope 20 and then return the envelope 20 to 40 ips before feeding the envelope 20 to the conveyor apparatus 200 while establishing the constant gap of 2.0 inches. On the other hand, if at 620 the answer is no, then at 624 the mailing machine operates in straight through mode where no gap correction takes place.

Figure 3:
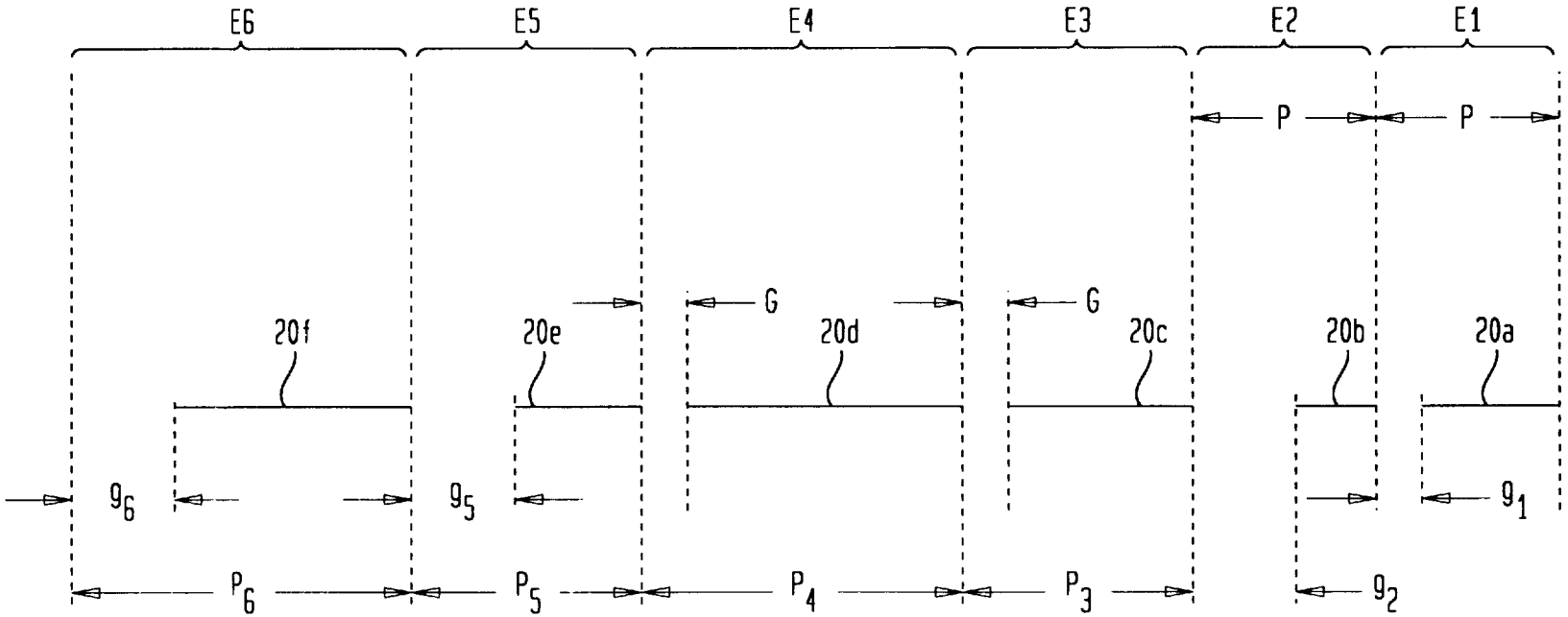
FIG. 3 is simplified schematic of a front elevational view of a sequence of mailpieces in transit through the mailing machine in accordance with the present invention.

To more clearly illustrate the operation of the mailing machine 10 in the various modes, a sequence of envelopes with their associated gaps E1–E6 in transit through the mailing machine 10 in accordance with the present invention are shown in FIG. 3. The sequences E1–E6 will primarily be described with reference to FIG. 3 while considering the structure of FIG. 1. In a sequence E1 the mailing machine 10 is operating in fixed pitch mode at the constant fixed pitch P of 11.5 inches. An envelope 20*a* is a #10 envelope having a length of 9.5 inches which results in an associated gap $g_1$ of 2.0 inches. In a sequence E2, the mailing machine 10 is also operating in fixed pitch mode at the constant fixed pitch P of 11.5 inches. However, an envelope 20*b* having a length of 6.5 inches is shown which results in an associated gap $g_2$ of 5.0 inches. Therefore, even though envelopes 20*a* and 20*b* have different lengths, their gaps $g_1$ and $g_2$, respectively, are such that the constant fixed pitch P is obtained.

In a sequence E3 the mailing machine 10 is operating in fixed gap mode at the constant gap G of 2.0 inches. The fixed gap mode results because an envelope 20*c* is greater than or equal to 9.5 inches in length. Accordingly, a pitch $p_3$ results which is greater than the constant fixed pitch P. In similar fashion, in a sequence E4 the mailing machine 10 is also operating in fixed gap mode at the constant gap G of 2.0 inches. Since envelope 20*d* is greater than or equal to 9.5 inches in length, the fixed gap mode results yielding a pitch $p_4$ which is greater than pitch $p_3$ because envelope 20*d* is longer than envelope 20*c*. Therefore, even though envelopes 20*c* and 20*d* have different lengths, their gaps G remain the same resulting in a variable pitch.

In a sequence E5 an envelope 20*e* having a length of 9.5 inches is shown which is equivalent in length to envelope 20*a*. However, the mailing machine 10 is operating in straight through mode instead of fixed pitch mode. This is a result of a measured gap $g_5$ which is greater than the desired gap of 2.0 inches for an envelope 20 of this length. Therefore, the fixed pitch mode is overridden and straight through mode results yielding a pitch $p_5$ which is greater than the constant fixed pitch P.

In a sequence E6 an envelope 20*f* having a length greater than 9.5 inches is shown which is equivalent in length to envelope 20*d*. However, the mailing machine 10 is operating in straight through mode instead of fixed gap mode. This is a result of a measured gap $g_6$ which is greater than the desired gap of 2.0 inches for envelopes over 9.5 inches. Therefore, the fixed gap mode is overridden and straight through mode results yielding a pitch $p_6$ which is greater than the pitch $p_4$.

Empirical studies have indicated that the natural gap which results due to: (1) the speed differential between the feeder assembly 410 and the take-away rollers 450; and (2) hesitation of the envelopes 20 passing through the nip between the feeder assembly 410 and the retard assembly 430 is generally in the range of 0.375 inches to 0.75 inches. The natural gap is influences by the length of the envelope 20 and the thickness of the envelope 20. However, since the natural gap is typically less than the desired gap, the mailing machine 10 operates primarily in fixed pitch and fixed gap modes.

Those skilled in the art will now recognize that by employing both fixed is pitch and fixed gap modes, the mailing machine 10 of the present invention operates with improved efficiency (throughput) and reliability over prior art systems. Mainly this is due to optimization of #10 envelopes at fixed pitch mode while handling larger envelopes at fixed gap mode.

Many features of the preferred embodiment represent design choices selected to best exploit the inventive concept as implemented in a mailing machine. However, those skilled in the art will recognize that various modifications can be made without departing from the spirit of the present invention. For example, the optical sensor of the sensor module 500 could be replace with an ultrasonic sensor or a photoelectric strip without any loss of performance. As another example, a second constant gap mode could exist where the gap is set to 1.0 inches for envelopes having a length over 12.0 inches. Therefore, the inventive concept in its broader aspects is not limited to the specific details of the preferred embodiment but is defined by the appended claims and their equivalents.

What is claimed is:

1. In a mailing machine, an apparatus for transporting mailpieces comprising:

means for feeding the mailpieces in a path of travel;

means for determining the length of the mailpieces; and control means in operative communication with the determining means and the feeding means, the control means for adjusting the gap between a first mailpiece having a determined length and a second mailpiece to establish a fixed pitch between the first mailpiece and the second mailpiece if the determined length is equal to or less than a predetermined value.

2. The apparatus of claim 1, wherein:

the control means is for adjusting the gap between the first mailpiece and the second mailpiece to establish a fixed gap between the first mailpiece and the second mailpiece if the determined length is greater than the predetermined value.

3. The apparatus of claim 2, further comprising:

means for determining the length of the gap between the first mailpiece and the second mailpiece prior to the control means adjusting the gap; and wherein the control means does not adjust the gap if the determined gap is greater than or equal to a desired gap.

4. The apparatus of claim 3, wherein:

the desired gap is dependent upon the determined length of the first mailpiece.

5. In a mailing machine, a method for transporting mailpieces comprising the step(s) of:

feeding the mailpieces in a path of travel;

determining the length of the mailpieces; and adjusting the gap between a first mailpiece having a determined length and a second mailpiece to establish a fixed pitch between the first mailpiece and the second mailpiece if the determined length is equal to or less than a predetermined value.

6. The method of claim 5, further comprising the step(s) of:

adjusting the gap between the first mailpiece and the second mailpiece to establish a fixed gap between the first mailpiece and the second mailpiece if the measure length is greater than the predetermined value.

7. The method of claim 6, further comprising the step(s) of:

determining the length of the gap between the first mailpiece and the second mailpiece prior to the control means adjusting the gap; and eliminating the adjusting step if the determined gap is greater than or equal to a desired gap.

8. The method of claim 7, wherein:

the desired gap is dependent upon the determined length of the first mailpiece.

* * * * *